US012590759B2

(12) United States Patent
Horne et al.

(10) Patent No.: US 12,590,759 B2
(45) Date of Patent: Mar. 31, 2026

(54) REMOVING HEAVY HYDROCARBONS TO PREVENT DEFROST SHUTDOWNS IN LNG PLANTS

(71) Applicant: Cheniere Energy, Inc., Houston, TX (US)

(72) Inventors: Hamish David William Horne, Katy, TX (US); Scott Oliver, Houston, TX (US); Timothy King Jordan, Lake Charles, LA (US); Matthew Peter Henderson, Port Neches, TX (US)

(73) Assignee: CHENIERE ENERGY, INC., Houston, TX (US)

( * ) Notice: Subject to any disclaimer, the term of this patent is extended or adjusted under 35 U.S.C. 154(b) by 140 days.

(21) Appl. No.: 18/471,994

(22) Filed: Sep. 21, 2023

(65) Prior Publication Data

US 2024/0011707 A1 Jan. 11, 2024

Related U.S. Application Data

(62) Division of application No. 17/113,820, filed on Dec. 7, 2020, now Pat. No. 11,808,517.

(51) Int. Cl.
*F25J 3/06* (2006.01)

(52) U.S. Cl.
CPC ..... *F25J 3/0615* (2013.01); *F25J 3/0695* (2013.01); *F25J 2205/50* (2013.01); *F25J 2210/62* (2013.01); *F25J 2220/64* (2013.01)

(58) Field of Classification Search
CPC ..... F25J 2220/60; F25J 2220/64
See application file for complete search history.

(56) References Cited

U.S. PATENT DOCUMENTS 4,608,069 A 8/1986 Becker et al.
10,989,469 B2 * 4/2021 Mak ..... C10L 3/12
(Continued)

FOREIGN PATENT DOCUMENTS

CN 202297537 U 7/2012
CN 107899381 A 4/2018
(Continued)

OTHER PUBLICATIONS

Ayala et al., "Evaluating Crystallization Risks in Liquefied-Natural-Gas (LNG) Production", OnePetro, SPE 110391, Jun. 2009, pp. 1-3
Ayala et al., "Evaluating Crystallization Risks in Liquefied-Natural-Gas (LNG) Production", OnePetro, SPE 110391, Jun. 2009, pp. 1-3.
(Continued)

*Primary Examiner* — Ana M Vazquez
(74) *Attorney, Agent, or Firm* — Duane Morris LLP

(57) ABSTRACT

Embodiments provide a method for preventing shutdowns in LNG facilities by removing heavy hydrocarbons from the inlet gas supply. According to an embodiment, there is provided an LNG facility treating pipeline quality natural gas that is contaminated with lubrication oil and low concentrations of heavy hydrocarbons. Due to contamination, the behavior of the pipeline quality natural gas is not properly predicted by thermodynamic modeling. In an embodiment, heavy hydrocarbons are removed by a drain system in a heat exchanger. In an embodiment, heavy hydrocarbons are removed by a treatment bed.

12 Claims, 6 Drawing Sheets

(56) References Cited

U.S. PATENT DOCUMENTS

| | | | |
|---|---|---|---|
| 2005/0178438 | A1 | 8/2005 | Renner |
| 2012/0079852 | A1 | 4/2012 | Northrop et al. |
| 2012/0240618 | A1 | 9/2012 | Vink et al. |
| 2013/0072740 | A1 | 3/2013 | Hillman |
| 2016/0282042 | A1 | 9/2016 | Nikiforuk |
| 2018/0328660 | A1 | 11/2018 | Rumore |
| 2019/0078840 | A1 | 3/2019 | Brussol et al. |
| 2019/0299153 | A1 | 10/2019 | Doong et al. |

FOREIGN PATENT DOCUMENTS

| | | | |
|---|---|---|---|
| FR | 3066258 | A1 | 11/2018 |
| JP | 2008542677 | A | 11/2008 |

OTHER PUBLICATIONS

Baker et al. "Advanced Predictions of Solidification in Cryogenic Natural Gas and LNG Processing", The Journal of Chemical Thermodynamics, vol. 137, Oct. 2019, pp. 22-33.
Baker et al., "Rapid Simulation of Solid Deposition in Cryogenic Heat Exchangers to Improve Risk Management in LNG Production", University of Australia, 33 pages.
Bjaanes, "Literature Review and Evaluation of the UMR-PRU EoS for Predicting Solid Formation in Low Temperature Natural Gas Processing", Norwegian University of Science and Technology, Apr. 2014, 123 pages.
CA3109576 Office Action dated Apr. 5, 2023, 6 pgs.
CA3109576 Office Action dated Sep. 1, 2022, 6 pgs.
Davis, et al., How to start up and shut down heat transfer systems, Oct. 2015, Process heating magazine.
Dodge, "Removal of Impurities From Gases To Be Processed At Low Temperatures", Yale University, Springer Science & Business Media, New York, 1972, pp. 37-38.
Engel, et al., Contamination in gas compression causes effects and solutions, Jul. 2020, Digital Refining.
Kazi, Fouling and Fouling Mitigation on Heat Exchanger Surfaces, Heat Exchangers edited by Jovan Mitrovic, Mar. 2012.
Lavik, "Freeze Out in Natural Gas Systems", Norwegian University of Science and Technology, Jun. 2009, 165 pages.
Nguyen, et al., Assessment of thermodynamic models for design, analysis and optimisation of gas liquefaction systems, Elsevier 2016.
Skylogianni, "Measurement and Modelling of Hydrocarbon Dew Points for Natural Gas", Master Thesis, Norwegian University of Science and Technology, 2012, pp. 1-87.
UOP SeparSIV System (UOP) For Lean Natural Gas Processing, UOP Honneywell Company, 2014, 2 pages.
Updegraff, "Gas Prepurification for Low-Temperature Processing", Journal vol. 53, Chem. Eng. Prog., Osti, Gov., 1957, pp. 1-3.

* cited by examiner

REMOVING HEAVY HYDROCARBONS TO PREVENT DEFROST SHUTDOWNS IN LNG PLANTS

CROSS-REFERENCE TO RELATED APPLICATION

This application is a divisional application of U.S. patent application Ser. No. 17/113,820, filed Dec. 7, 2020, titled, "Removing Heavy Hydrocarbons to Prevent Defrost Shutdowns in LNG Plants, of which is incorporated by reference herein.

BACKGROUND

Field

Embodiments relate to a method to remove heavy hydrocarbons from natural gas. Specifically, embodiments relate to a method to remove lube oil and related contaminated heavy hydrocarbons from pipeline quality natural gas at the front end of a liquefied natural gas export facility to prevent defrost shutdowns.

Description of Related Art

Liquefied Natural Gas (LNG) is natural gas cooled to approximately −162° C. or −260° F. to generate a condensed liquid phase. Generally, LNG is comprised primarily of methane, but often includes ethane. Before cooling, the natural gas is processed to remove water, carbon dioxide ($CO_2$), sulfur components, heavy hydrocarbons, and other components.

LNG is generated in facilities with cryogenic cooling capabilities. One process for liquefying natural gas is a cascade process, which involves cooling the natural gas using another cooled gas, which was cooled by another gas. A second process for liquefaction is the Linde process, or Claude process, where natural gas is passed through an orifice causing expansion on the downstream side until it is cooled to the proper temperature. A third process for liquefaction is the Air Products process, which includes an integrated, multi-pass cryogenic Main Cryogenic Heat Exchanger (MCHE) to cool and liquefy natural gas with a mixed component hydrocarbon refrigerant. In one of the MCHE's integrated steps, the cooled natural gas passes through a distillation column where natural gas condensate and heavy hydrocarbons are separated before natural gas reaches cryogenic temperatures.

Generally, LNG facilities use unprocessed or minimally treated natural gas directly from a reservoir. This natural gas may have gone through preliminary treatment such as removing heavier hydrocarbons that liquefy at atmospheric conditions and preliminary dehydration to remove water at a field site before being transported via pipelines to the LNG facility. However, the natural gas has not been transported long distances in interstate pipelines. The natural gas introduced to these LNG facilities at this point is not pipeline quality gas and does not meet commercial fuel gas specifications. It is also unsuitable for exposure to the cryogenic conditions required for liquefaction. Therefore, typical LNG facilities require substantial pre-treatment of the natural gas by removing sulfur compounds, $CO_2$, water, mercury, and heavy hydrocarbons, including the removal of C3+ hydrocarbons.

Thermodynamic modeling is often used to understand and predict how natural gas will behave during treatment at facilities. For example, thermodynamic modeling can predict the temperatures and pressures where liquids formation can occur in equipment, or where possible solids formation from freeze-outs can occur. A commonly used thermodynamic modeling software for LNG facilities is ASPEN HYSYS® (from AspenTech). Often, the Peng-Robinson equation of state is used as the basis for the thermodynamic modeling. Recently, a large body of work has been focused on the inaccuracies of modeling methane and binary mixtures of methane with another component when approaching the temperature and pressures associated with the vapor/liquid boundaries. However, these examples are focused on extremely low temperature modeling, and the deviation between model predictions and laboratory results are relatively minor (for example, 20° C.). Even with these slight inaccuracies, thermodynamic modeling is still used to design and operate typical LNG facilities, especially equipment and processes handling gas at higher cryogenic temperatures, such as greater than −100° F.

LNG facilities thus far have been designed to treat and liquefy natural gas directly from or close to reservoirs, and thus have not been designed to treat large quantities of pipeline quality natural gas, including pipeline quality natural gas that has traveled long distances in interstate pipelines and that has undergone significant treatment required to meet interstate pipeline quality specifications. The contamination and operating conditions required for LNG facilities supplied with only pipeline quality natural gas can lead to additional complications in treatment at LNG facilities. These complications can include problems with the thermodynamic modeling predictions. The combination of chemical contamination in pipeline quality natural gas, the presence of small quantities of heavy hydrocarbons, the high volume of throughput of LNG facilities, and the inability of thermodynamic modeling to accurately predict the behavior of the heavy hydrocarbons even at unexceptional cryogenic temperatures generate a unique problem present only in LNG facilities handling pipeline quality natural gas. Therefore, a need exists to address the additional issues related to the use of pipeline quality natural gas in LNG facilities.

SUMMARY

Embodiments of the invention provide a method to remove heavy hydrocarbons from natural gas in an LNG facility. According to various embodiments, the method for preventing heat exchanger operation loss by removing contaminants includes introducing a natural gas stream to an LNG facility, where the natural gas stream has been transported long distances in pipelines requiring compression so that the natural gas has come into contact with a lubrication oil. According to at least one embodiment, the lubrication oil includes a contaminant. According to at least one embodiment, the natural gas stream includes methane, ethane, and a plurality of heavy hydrocarbon species. According to at least one embodiment, the method also includes reducing the temperature of the natural gas stream in a heat exchanger process unit so that the contaminant in the lubrication oil allows for a conglomeration of the heavy hydrocarbon species, and removing the conglomeration of the heavy hydrocarbon species from the heat exchanger process unit through one or more drains so that the conglomeration of the heavy hydrocarbons is removed preventing a blockage in the heat exchanger process unit, where the blockage would require a defrost to remove.

According to at least one embodiment, the method also includes providing the heat exchanger unit with a first throughput based on a design throughput, where the design throughput is calculated from a traditional thermodynamic model and design operational conditions of the heat exchanger process unit, so that the design throughput is an amount of natural gas throughput the heat exchange process unit can efficiently treat within safety and operational limits; and reducing the amount of natural gas sent to the heat exchanger process unit, so that the heat exchanger process unit is provided with a second throughput, where the second throughput is less than the design throughput. According to at least one embodiment, the second throughput is less than 75% of the first throughput. According to at least one embodiment, the natural gas meets an interstate pipeline quality standard.

According to various embodiments, a method to remove heavy hydrocarbons to prevent maintenance shutdowns at an LNG facility treating pipeline quality natural gas includes providing a natural gas stream, where the natural gas stream includes methane, ethane, and heavy hydrocarbons; splitting the natural gas stream to generate a heat exchanger feed stream and a bypass portion; controlling an amount of the bypass portion by a bypass valve; passing the bypass portion through the bypass valve generating a bypass stream; reducing the temperature of the heat exchanger feed stream in a heat exchanger; removing a heat exchanger outlet stream from the heat exchanger, where the heat exchanger outlet stream is at a lower temperature than the heat exchanger feed stream; removing a downstream heavy hydrocarbon stream from a downstream drain line, where the downstream heavy hydrocarbon stream includes heavy hydrocarbons that have been congealed due to a contaminant in the natural gas stream; passing the heat exchanger outlet stream through a heat exchanger outlet flow control valve generating a cooled natural gas stream; and introducing the cooled natural gas stream to the bypass stream to generate a combined outlet stream.

According to at least one embodiment, the method also includes calculating a design heat exchanger throughput based on thermodynamic modeling and a set of design parameters established for the heat exchanger; and operating the heat exchanger with a reduced throughput, where the reduced throughput is less than the design heat exchanger throughput.

According to at least one embodiment, the method also includes operating the heat exchanger with the reduced throughput by manipulating the bypass valve and heat exchanger outlet flow control valve. According to at least one embodiment, the reduced throughput is less than 60% of the design heat exchanger throughput. According to at least one embodiment, the heat exchanger outlet flow control valve is set at an outlet flow control valve position, where the outlet flow control valve positions is 33% of full open, and where the bypass valve is set at a bypass valve position, where the bypass valve position is 50% of full open.

According to at least one embodiment, the upstream drain line is allowed to drain during ramp-up such that there is a reduction in a potential to carryover liquid. According to at least one embodiment, the natural gas stream has a condensation temperature, where the condensation temperature is the temperature at which liquids and solids begin to form based on the composition of the natural gas stream and the known thermodynamic properties available in traditional thermodynamic modeling packages; where the heat exchanger is operable to reduce the temperature of the heat exchanger feed stream to a heat exchanger outlet stream temperature above the condensation temperature; and where the heat exchanger is inundated with solids, liquids, and a congealed heavy hydrocarbon. According to at least one embodiment, the natural gas stream has a condensation temperature so that the condensation temperature is the temperature at which liquids and solids begin to form based on laboratory testing of the downstream heavy hydrocarbon stream; where the heat exchanger is operable to reduce the temperature of the heat exchanger feed stream to a heat exchanger outlet stream temperature below the condensation temperature, and where a solid ice does not form in the heat exchanger.

According to at least one embodiment, the contaminant is selected from a group consisting of a lubrication oil, an additive in a lubrication oil additive package, a plurality of C20+ compounds, a plurality of C40+ compounds, an additive which causes conglomeration of hydrocarbons, and combinations of the same. According to at least one embodiment, the natural gas stream includes pipeline quality natural gas.

According to various embodiments, a method for removing heavy hydrocarbons from pipeline quality natural gas at an LNG facility includes introducing a bed feed stream to a treatment bed, where the bed feed stream includes methane, ethane, heavy hydrocarbons, and a contaminant, and where the treatment bed include an absorbent material operable to remove heavy hydrocarbons from the bed feed stream; absorbing heavy hydrocarbons from the bed feed stream in the treatment bed, so that heavy hydrocarbons accumulate in the absorbent material; removing a treated natural gas stream from the treatment bed; combining the bypass stream and the treated natural gas stream to form an LNG feed; and introducing the LNG feed to an LNG plant, the LNG plant operable to process and liquefy natural gas generating a liquefied natural gas stream.

According to at least one embodiment, the absorbent material is sacrificial so that after a material lifespan has passed, the absorbent material is removed from the absorbent bed and is discarded. According to at least one embodiment, the absorbent material is regenerative, and the method includes introducing a regeneration gas to the absorbent bed material, so that the temperature and flow of the regeneration gas removes the heavy hydrocarbons from the absorbent material, and removing a saturated regeneration gas from the treatment bed. According to at least one embodiment, the absorbent material includes a molecular sieve, the molecular sieve operable to absorb the heavy hydrocarbons present in the bed feed stream.

A method for heavy hydrocarbon removal according to various embodiments.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well.

DETAILED DESCRIPTION

Figure 1:
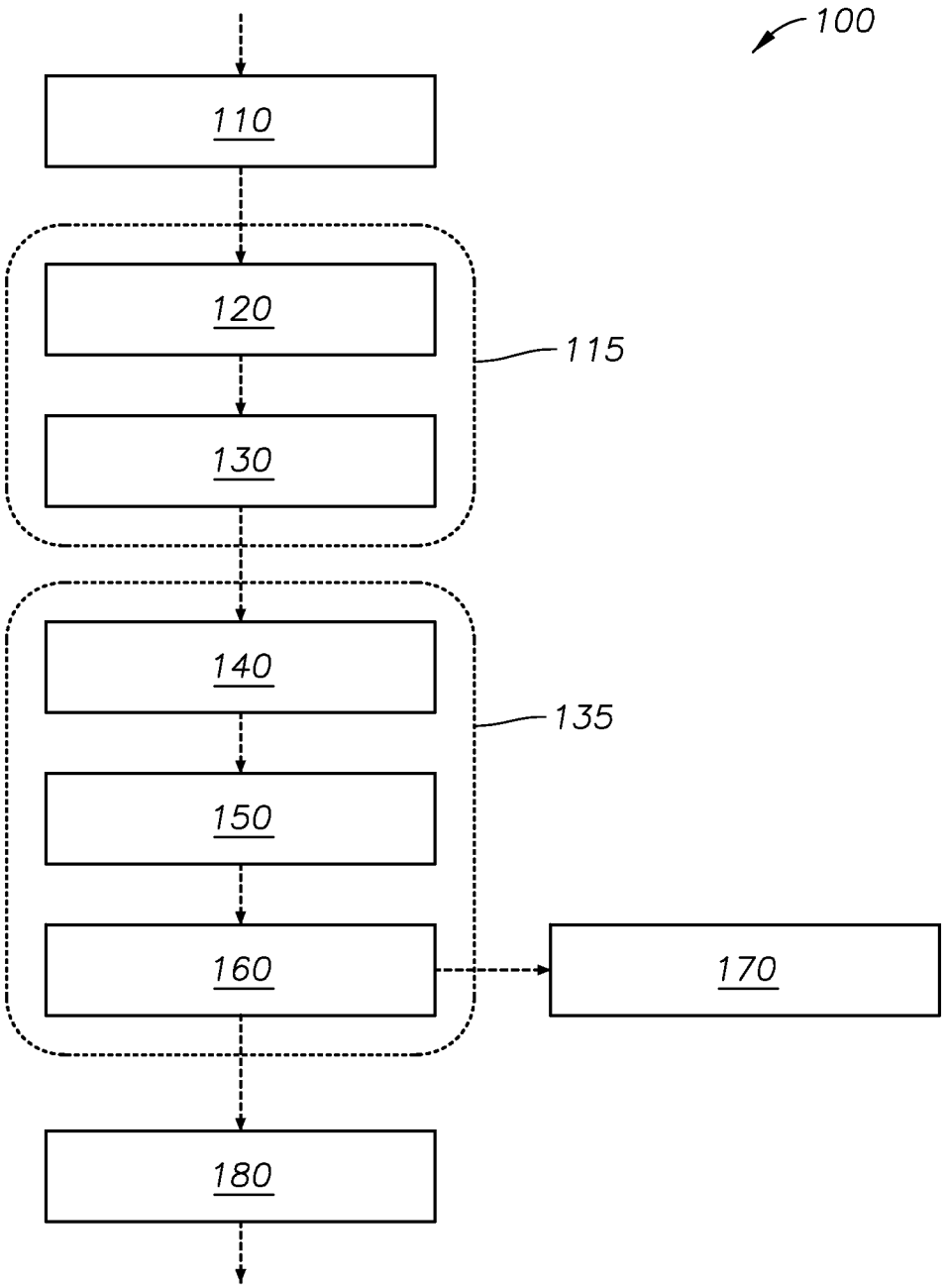
FIG. 1 is a step diagram of an LNG facility featuring a cascade process according to an embodiment.

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art.

Modes for carrying out the various embodiments will now be described, but the invention is not intended to be limited to the following embodiments. It should be understood that those in which changes, improvements, or the like are appropriately added to the following embodiments based on ordinary knowledge of a person skilled in the art are also included in the scope of the various embodiments without departing from the spirit of the invention.

For simplicity and clarity of illustration, the drawing figures illustrate the general manner of construction, and descriptions and details of well-known features and techniques may be omitted to avoid unnecessarily obscuring the discussion of the described embodiments. Additionally, elements in the drawing figures are not necessarily drawn to scale. For example, the dimensions of some of the elements in the figure may be exaggerated relative to other elements to help improve understanding of embodiments. Like reference numerals refer to like elements throughout the specification.

The description may use the phrases "in some embodiments," "in an embodiment," or "in embodiments," which can each refer to one or more of the same or different embodiments. Furthermore, the terms "comprising," "including," "containing," and the like, as used with respect to embodiments of the present disclosure, are synonymous.

As used in this disclosure, the term "about" is utilized to represent the inherent degree of uncertainty that may be attributed to any quantitative comparison, value, measurement, or other representation. The term "about" is also utilized in this disclosure to represent the degree by which a quantitative representation can vary from a stated reference without resulting in a change in the basic function of the subject matter at issue.

The singular forms "a," "an," and "the" include plural references, unless the context clearly dictates otherwise.

Ranges may be expressed throughout as from about one particular value, or to about another particular value. When such a range is expressed, it is to be understood that another embodiment is from the one particular value or to the other particular value, along with all combinations within said range.

The term "natural gas" refers to a blend of hydrocarbons comprised of primarily methane and ethane, and also including propane, butanes, butenes, pentanes, pentenes, and other C6+ components. Natural gas can also include contaminants such as water, $CO_2$, hydrogen sulfide ($H_2S$), other sulfur compounds, and mercury. Natural gas can also include heavy hydrocarbons that can reside in a liquid state at standard temperature and pressure.

The term "pipeline quality natural gas" refers to natural gas that could have been treated to attain pipeline quality standards, thus meeting the pipeline specifications for the gas, and has been transported in intrastate and interstate pipelines. This includes a possibility of partial removal of water, $CO_2$, $H_2S$, other sulfur compounds, and heavy hydrocarbons. Pipeline quality natural gas is considered high quality natural gas and is often considered of an appropriate quality for many industrial and commercial uses. Pipeline quality natural gas can be introduced to large interstate pipelines, where it is compressed in compression stations to propel the gas down the pipeline. Interstate pipelines are those pipelines that cross state lines. Intrastate pipelines are those pipelines that reside within one state's boundaries. Intrastate pipelines can also require compression to propel gas down the pipeline. In this disclosure, the term "pipeline quality natural gas" denotes that the natural gas has passed through equipment resulting in contact with lubrication oil, and is thus possibly contaminated with lubrication oil.

The term "lubrication oil" refers to oils and compounds used as a lubricant in machinery, such as in the pipeline compressors. Lubrication oils can contain lubrication oil additives or lubrication oil additive packages. "Lubrication oil additives" or "additive packages" refer to the chemicals added to the lubrication oil in order to stabilize the lubrication oils. These chemicals act to conglomerate and stabilize the oil so that the oil does not break down or separate over time. In this disclosure, a reference to "lubrication oils" includes a reference to the included lubrication oil additives or additive packages. These lubrication oils and additive packages can include C20+ hydrocarbons. Other components found in lubrication oil additives include long chain hydrocarbons, paraffin-like compounds, and compounds with carbon-rich base material with chromium, iron, cobalt, nickel, sodium, chloride, calcium titanium, barium, or tungsten.

The term "heavy hydrocarbons" refers to those hydrocarbons which have a carbon number of 6 or greater, including C6+, C12+, C14+, C20+, and C40+.

Hereinafter, methods for removing heavy hydrocarbons in an LNG facility according to various embodiments will now be specifically described herein. However, embodiments broadly include any methods and systems to remove heavy hydrocarbons that include the matters used to specify the present invention, and the present invention is not limited to the embodiments described below.

LNG facilities that accept pipeline quality natural gas can require less pre-treatment of the feed gas entering the facility as compared to LNG facilities that accept poorer quality gas directly from or near a reservoir. The pipeline quality natural gas LNG facilities, however, can still have issues related to gas quality. The pipeline quality natural gas can contain heavy hydrocarbons naturally found in natural gas, such as C6+ hydrocarbons. The pipeline quality natural gas can also contain extremely small concentrations (<100 ppb) of very heavy components (C20+) from lubricating oils. The lubricating oils can also contain conglomerating additives. These contaminants can be introduced to the pipeline quality natural gas from gas network compressors present in the intrastate and interstate pipeline system. Although these heavy hydrocarbons and contaminants do not cause issues with other industrial or commercial applications, due to the large volume of natural gas throughput LNG facilities handle, the LNG facility ends up handling large masses of contaminants, and small concentrations of contaminants conglomerating or concentrating within the system result in significant masses of contaminants that can have significant effect on the operation of LNG plants and can result in unique problems that only LNG facilities handling large volumes of pipeline quality natural gas will experience.

LNG facility equipment operating at cryogenic temperatures can become inoperably blocked. The root cause of the blockages can be solidification of heavy hydrocarbons in the equipment. LNG facilities utilizing pipeline quality natural gas can also experience these re-occurring blockages, even with low concentrations of heavy hydrocarbons. Heat exchangers used to chill the natural gas, particularly core-and-kettle and braised aluminum plate-and-fin style, are especially prone to the blockages. Equipment blockages require an LNG train defrost to clear the blockage. In one facility handling pipeline quality natural gas, LNG train defrosts approximately every 3 months. Typical LNG facilities require defrosts every 12-24 months due to hydrocarbon ice buildup in equipment. Quarterly defrosts are considered excessive. In a typical defrost, the cryogenic equipment is warmed to standard temperature, generally with a defrost gas stream, allowing the solids formed to melt over time as the temperature rises. Without being bound by theory, it is believed that the blockages can be exacerbated by transient swings in feed flow through the heat exchanger during startup, which results in an increased liquid buildup in the core at lower temperatures.

In an embodiment, the pipeline quality natural gas stream treated in the LNG facility can contain small quantities of heavy hydrocarbons such as C6+ and still meet pipeline quality natural gas specifications. The pipeline quality natural gas can also contain minute concentrations of other lubrications oils, which are also heavy hydrocarbons in the C20+ range, as well as lubrication oil additives. The lubrication oil additives act to conglomerate heavy hydrocarbons together, resulting in viscosification, liquefaction, and solidification of the heavy hydrocarbons. Although the concentration of heavy hydrocarbons, lubrication oils, and lubrication oil additives are extremely low in the pipeline quality natural gas, the large volumes of gas treated at LNG plants results in a significant quantity of these components traveling through the equipment. As the heavy hydrocarbons begin to conglomerate, the heavy hydrocarbons form a liquid, viscous gel, or solid that begins to block the equipment, causing the pressure in the equipment to rise. As more gas travels through the equipment, the lubrication oil additives continue to aggregate the heavy hydrocarbons from the pipeline quality natural gas in the equipment.

In some embodiments, this equipment is a heat exchanger, and the differential pressure across the heat exchanger begins to rise. In some of these embodiments, the problem is compounded when, in order to stay within the operational limitations of the heat exchanger equipment, the inlet gas flow throughput must be decreased to stay within the differential pressure limits imposed by the heat exchanger design and construction. This action reduces the velocity of the gas flowing through the heat exchanger and surrounding equipment, causing the inlet gas temperature to become colder, which can compound the problem and contribute to additional solidification of heavy hydrocarbons. The design of the surrounding equipment, including piping layouts with low-points in the line, can exacerbate the problem.

Unexpectedly, the engineering tools used for designing and operating LNG facilities, including traditional thermodynamic modeling, do not accurately predict heavy hydrocarbon liquefaction, solidification, or conglomeration for pipeline quality natural gas at the temperatures and pressures experienced in the cryogenic equipment, including in the heat exchangers. Even when experiencing higher, or unexceptional, cryogenic temperatures, such as temperatures greater than −50° C., where thermodynamic modeling is expected to provide relatively accurate predictions regarding solidification and liquefaction of heavy hydrocarbons, it has been discovered that the models are unable to accurately predict the freezing points, liquefaction points, boiling points, or other physical properties of the heavy hydrocarbon components in the pipeline quality natural gas at LNG facilities. These engineering tools and thermodynamic models are unable to effectively predict the physical properties of the heavy hydrocarbons in pipeline quality natural gas at LNG facilities because the heavy hydrocarbons include lubrication oils and contaminants, including lubrication oil additives. The lubrication oils and the lubrication oil additives alter the physical properties and physical behaviors of the heavy hydrocarbons in the pipeline quality natural gas. The lubrication oil additives are designed to prevent lubrication oils from thermal and physical breakdown, and act to aggregate heavy hydrocarbons preventing breakdown and separation. When the lubrication oil additives are present, the engineering tools and thermodynamic modeling can no longer be relied upon for accurate design and operational engineering. Due to the changes in physical properties caused by the presence of the lubrication oil and lubrication oil additives, traditional ways of removing or otherwise treating the heavy hydrocarbons are also affected. Even when the inputs for the thermodynamic modeling are reflective of the presence of the heavy hydrocarbons present in lubrication oils, the models still do not accurately predict the physical properties because there is no adjustment or factor for the presence of the lubrication oil additives.

Embodiments disclosed herein relate to methods for the treatment of pipeline quality natural gas to remove heavy hydrocarbons in an LNG facility to therefore prevent blockages and the need to defrost equipment to remove blockages. According to at least one embodiment, the methods involve treating pipeline quality natural gas that has come into contact with a lubrication oil. According to at least one embodiment, the methods include installing one or more drain lines in the natural gas lines leading to and from the heat exchangers at an LNG facility. The heat exchanger can be any type of process equipment that lowers the temperature of the pipeline quality natural gas. According to at least one embodiment, the method further includes the reduction of throughput of the natural gas through the heat exchanger below the design throughput of the heat exchanger. According to at least one embodiment, the drain lines are installed on the upstream side of the natural gas lines feeding the heat exchanger. According to at least one embodiment, the drain lines are installed on the downstream side of the natural gas lines leading outside the heat exchangers. According to at least one embodiment, the throughput is controlled by manipulating bypass valves and flow control valves. According to at least one embodiment, the drain lines are emptied manually. According to at least one embodiment, the drain lines are opened based on sensors, or automatically. According to at least one embodiment, the pipeline quality natural gas has come into contact with lubrication oil which contains a contaminant, the contaminant acts to increase the freeze out point of the natural gas. According to at least one embodiment, the pipeline quality natural gas has come into contact with lubrication oil, which contains a contaminant, the contaminant acts to conglomerate heavy hydrocarbons at temperatures higher than expected through traditional thermodynamic modeling.

According to at least one embodiment, the methods for the treatment of pipeline quality natural gas to remove heavy hydrocarbons in an LNG facility involve treating pipeline quality natural gas that has come into contact with a lubrication oil by a treatment bed. According to at least one embodiment, the treatment bed is placed on the inlet stream of natural gas feeding the LNG facility. According to at least one embodiment, the treatment bed is filled with an absorbent material. According to at least one embodiment, the absorbent material is sacrificial and is disposed of once the material has ended its useful life. According to at least one embodiment, the treatment bed is filled with a material that can be regenerated at high temperature using a regenerative gas stream.

(A) LNG Facility Process

A typical LNG facility with cascade process 100 is shown in FIG. 1. LNG processes involve Inlet Systems 110, Pre-Treatment 115, Refrigeration and Liquefaction 135, NGL Recovery and Fractionation 170, and LNG Transport 180. The invention disclosed herein can be employed in this or similar LNG cascade processes. The invention disclosed herein can also be employed in other types of LNG processes. In this process, raw natural gas is introduced to Inlet Systems 110. The Inlet Systems can include metering, liquids removal, and other standard equipment known in the art. The gas is then introduced to Pre-treatment 115. Pre-treatment includes Acid Gas Removal 120, where $H_2S$ and $CO_2$ are removed from the gas. Acid Gas Removal 120 can include solvent removal processes, such as amine, or absorption bed processes, such as regenerative bed absorption. Water and mercury are then removed in a Dehydration and Mercury Removal step 130. Due to the extremely low concentrations of water allowed in the LNG process, dehydration normally involves molecular sieve processes. The gas then undergoes Refrigeration and Liquefaction 135. Refrigeration and Liquefaction 135 includes dropping the temperature of the gas through various methods. In the cascade processes pictured, the gas begins the process of cooling with Propane Refrigeration 140 followed by Ethylene Refrigeration 150. Heavy hydrocarbons can be removed at various stages in the process, including between heat exchangers. The gas finally undergoes Liquefaction and Methane Refrigeration 160, where natural gas liquids (NGLs) are recovered and separated into various components in NGL Recovery and Fractionation 170, and LNG is prepared for transportation in LNG Transport 180.

Most LNG facilities utilize raw natural gas that has undergone little to no treatment prior to being introduced to the LNG facilities. In the embodiments described herein, pipeline quality natural gas is utilized as a feed for the LNG process. Although the pipeline quality natural gas could have gone through extensive treatment in order to meet pipeline specifications, even higher specifications must be met to properly treat the natural gas and liquefy the methane component. Without the additional treatment, even extremely low amounts of $CO_2$, water, and heavy hydrocarbons can cause process upsets as the $CO_2$ and water can solidify into hydrates, and heavy hydrocarbons can liquefy and solidify in equipment not designed to handle liquids if not removed before the final stages of the LNG process. Mercury can liquefy and collect in equipment due to its density, causing corrosion and health, safety, and environmental concerns. Therefore, even pipeline quality natural gas must go through the Inlet Systems, Acid Gas Removal, and Dehydration and Mercury Removal before refrigeration.

In an embodiment, the pipeline quality natural gas goes through additional treatment, including the additional removal of carbon dioxide through an amine-based contacting tower or absorbent beds, and dehydration through contacting towers or molecular sieve absorbent beds. In an embodiment during carbon dioxide removal, the carbon dioxide concentration in the pipeline quality natural gas drops in concentration from approximately 1.30 mole percent (mol %) to approximately 0.01 mol %. In an embodiment, the carbon dioxide concentration in the natural gas after carbon dioxide removal is less than 0.05 mol %. In an embodiment, the carbon dioxide concentration in the natural gas after carbon dioxide removal is less than 0.02 mol %. In an embodiment, the water concentration in the natural gas after dehydration is less than 0.02 mol %. In an embodiment, the water concentration in the natural gas after dehydration is less than 0.01 mol %.

Thermodynamic modeling is often used to assist in designing an LNG facility and the associated equipment. In addition, the thermodynamic modeling assists in predicting where liquefaction or solidification of materials can occur during the normal operating conditions of the equipment given a specific natural gas stream composition. Thermodynamic modeling of LNG plants can be difficult due to the inability of the models to predict methane behavior at extremely low temperatures. Most of the related problems with thermodynamic modeling currently experienced is related to the difficulty of predicting the molecular interactions of methane and a secondary component at extreme temperatures and pressures near the vapor/liquid phase boundary, for example, less than about −160° F.

Typically, within the LNG industry, there is an understanding that pipeline quality natural gas contains a negligible amount of heavy hydrocarbons, usually less than 0.05 mol %, that freeze at temperatures warmer than −20° F. Therefore, the effects of the heavy hydrocarbons are generally ignored. Heavy hydrocarbons that freeze at colder temperatures can be removed in equipment specifically designed for heavy hydrocarbon removal, such as removal or scrub columns. Therefore, LNG facilities are generally designed to remove these heavier hydrocarbons downstream in the system where temperatures are well below the −20° F. threshold. However, in an embodiment, this conventional understanding is incorrect in that, surprisingly and unexpectedly, these low levels of heavy hydrocarbons do have an effect on processing at temperatures greater than −20° F., and have an even greater effect than originally recognized at temperatures colder than −20° F. In an embodiment, due to the unprecedented and unexpected effect of the heavy hydrocarbons in pipeline quality natural gas, the heavy hydrocarbon removal systems in LNG facilities are not located far enough upstream to remove hydrocarbons while the gas is at a warm enough temperature to not cause operational issues. In an embodiment, the effect of the heavy hydrocarbons is exacerbated by the contamination of the natural gas by lubrication oil and lubrication oil additive packages. In an embodiment, the thermodynamic modeling of LNG facilities with low concentrations of heavy hydrocarbons is performed, but the computer simulation software does not accurately predict the heavy hydrocarbon behavior when dealing with low concentrations of heavy hydrocarbons, especially when dealing with C20+ and C40+ hydrocarbon groups. In an embodiment, these C20+ and C40+ hydrocarbons include components from lubrication oil and lubrication oil additive packages. While not being bound by theory, it is believed that these components act as conglomerating materials, collecting and agglomerating various heavy hydrocarbon components, including C6+, maintaining the heavy hydrocarbon components in a viscous liquid or viscous gel state. These components prevent the thermodynamic models from appropriately predicting the behavior of the heavy hydrocarbons.

(B) Natural Gas Feed

Figure 2:
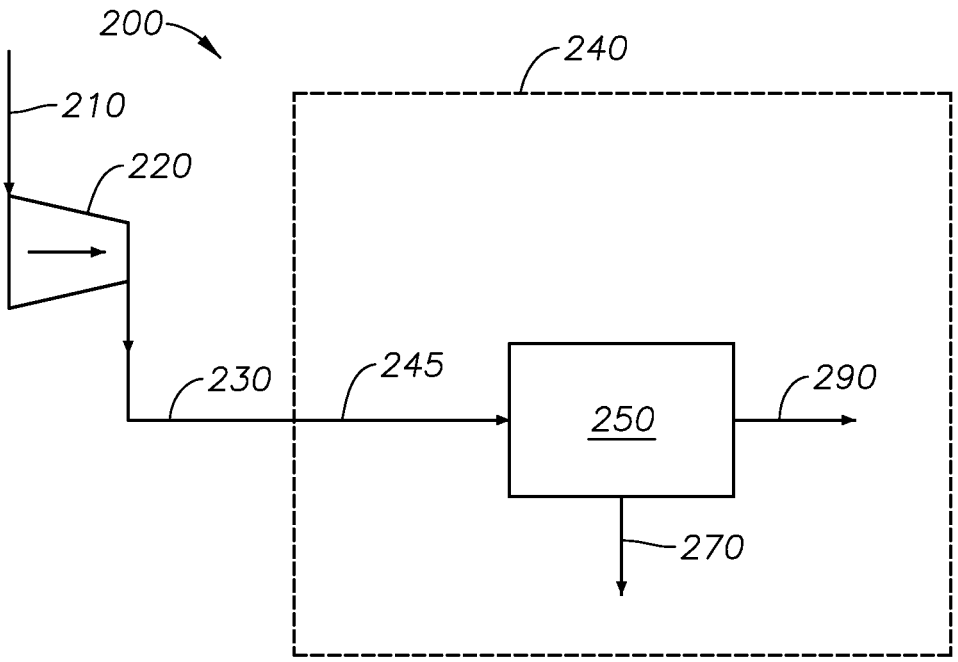
FIG. 2 is a process diagram of a heat exchanger drain system on a pipeline quality natural gas fed LNG facility according to an embodiment.

A simplified natural gas system 200 is shown in FIG. 2 according to an embodiment. FIG. 2 shows a pipeline stream 210. The pipeline stream 210 can be an interstate pipeline or an intrastate pipeline. According to an embodiment, the pipeline stream 210 contains pipeline quality natural gas at typical pressure and temperature conditions. In an embodiment, the pipeline stream 210 contains at least about 90 mol % methane, or alternately at least about 92 mol % methane, or alternately at least about 95 mol % methane, or alternately at least about 97 mol % methane. In an embodiment, the pipeline stream 210 contains less than about 4 mol % $CO_2$, or alternately less than about 3 mol % $CO_2$, or alternately less than about 2.5 mol % $CO_2$, or alternately less than about 2.0 mol % $CO_2$. In an embodiment, the pipeline stream 210 contains less than about 5 mol % C3+ components, or alternately less than about 3 mol % C3+ components, or alternately less than about 2 mol % C3+ components. In an embodiment, the pipeline stream 210 also contains residual C6+ components occurring in natural gas before introduction into the natural gas pipeline system, in the concentrations of less than 1 mol %, or alternately less than 0.5 mol %, or alternately less than 0.1 mol %. The pipeline stream 210 is fed into a pipeline compressor station 220 that includes compressors and other equipment. The compressor station 220 operates to increase the pressure of the natural gas in the pipeline. In an embodiment, the compressors and other equipment use lubrication oil, which contains additive packages. In an embodiment, the lubrication oil leaks into the natural gas during normal operations. Therefore, in an embodiment, a natural gas stream 230 exiting the pipeline compressor station 220 is contaminated with the lubrication oils. Small amounts of the lubrication oils, including additive packages, can enter the natural gas stream 230 from the compressors and equipment in the compressor station 220 through normal operations. In an embodiment, the natural gas stream 230 contains the same quantities of methane, $CO_2$, and C3+ components as the pipeline stream 210, with the addition of ppm levels of C20+ hydrocarbons from the lubrication oils and additive packages. In an embodiment, the natural gas stream 230 contains less than 0.01 mol % C20+ hydrocarbons. In an embodiment, the natural gas stream 230 contains less than about 100 ppm of C20+ hydrocarbons. In an embodiment, the natural gas stream 230 has a temperature in the range of about 60° F. to about 100° F. In an embodiment, the natural gas stream 230 has a pressure in the range of about 850 psig to about 1200 psig.

In an embodiment, after leaving the compressor station 220, the natural gas stream 230 is introduced to an LNG facility 240. The LNG facility 240 can include the processes disclosed in FIG. 1. The LNG facility 240 can have some of the processes disclosed in FIG. 1, but occurring in a different order or without certain processes. In an embodiment, as the natural gas stream 230 is introduced to the LNG facility 240, the natural gas stream 230 can be treated through a variety of processes including dehydration and acid gas removal, generating the heat exchanger feed stream 245. In an embodiment, the heat exchanger feed stream 245 has the same composition as the natural gas stream 230.

(C) Heat Exchanger

According to an embodiment, heat exchangers, also referred to as chillers, drop the temperature of the gas to prepare for and to begin the cryogenic processes in the LNG facility. Heat exchangers in an LNG facility can be placed in series to slowly lower the temperature of the natural gas, such as in a cascade process.

In an embodiment, the LNG facility 240 includes a heat exchanger process unit 250. The heat exchanger process unit 250 can be equipment in an ethylene refrigeration unit, a propane refrigeration unit, or other refrigeration unit. The heat exchanger process unit 250 can include any type of heat exchanger with a purpose of reducing the temperature of the natural gas stream 230. The heat exchanger process unit 250 can include any variety of equipment, valves, measurement devices, piping, and ancillary equipment.

In an embodiment, the heat exchanger feed stream 245 is introduced to the heat exchanger 250. The heat exchanger feed stream 245, at the point of entrance to the heat exchanger 250, can be at a temperature less than 80° F. In an embodiment, the natural gas stream 310 is less than about 50° F. In an embodiment, the heat exchanger feed stream 245 at the point of entrance to the heat exchanger process unit 250 is less than 0° F. In an embodiment, the heat exchanger feed stream 245 at the point of entrance to the heat exchanger process unit 250 is less than −20° F. In an embodiment, the heat exchanger feed stream 245 has a pressure in the range of 700-900 psig.

According to an embodiment, heavy hydrocarbons congeal inside the heat exchanger process unit 250, forming a conglomeration of heavy hydrocarbons. In an embodiment, the conglomeration takes the form of a viscous gel that is neither a solid block of ice nor a flowing liquid. If not removed, the conglomeration of heavy hydrocarbons builds up and congeals enough to generate a blockage in the heat exchanger process unit 250. In an embodiment, the thermodynamic modeling generated during the design phases show that the heavy hydrocarbons would not enter a liquid phase. In an embodiment, the thermodynamic modeling did not predict solids formation or liquids formation at that temperature and pressure and operating conditions the heat exchanger process unit 250 was designed for; however, during operations the heavy hydrocarbons form a congealed substance. In an embodiment, the thermodynamic model underestimates the temperature for vapor/liquid phase changes by as much as 250° F. In an embodiment, the thermodynamic modeling generated during the design phases show that the heavy hydrocarbons would enter a solids phase. In an embodiment, the thermodynamic modeling predicted solids formation at that temperature and pressure and operating conditions the heat exchanger process unit 250 was designed for; however, during operations the heavy hydrocarbons did not solidify into an ice-like formation, but instead formed into a viscous gel.

According to an embodiment, the thermodynamic modeling does not or cannot take into account for lubrication oils and additive packages. Therefore, in an embodiment, the liquidation and consolidation of the heavy hydrocarbons in the heat exchanger process unit 250 is not properly predicted by the thermodynamic models. In an embodiment, the thermodynamic modeling cannot factor in the specific components of additive packages and the effect in conglomerating heavy hydrocarbons. In an embodiment, the additive packages are proprietary and exact compounds are unknown.

According to an embodiment, the heat exchanger process unit 250 includes a system that removes heavy hydrocarbons through a drain, generating a heat exchanger process unit drain stream 270. The heavy hydrocarbons include C6+, C14+, C20+ or C40+ hydrocarbons; the additive packages; or lubrication oil.

According to an embodiment, the heat exchanger process unit 250 generates a heat exchanger process unit outlet stream 290. The heat exchanger process unit outlet stream 290 includes natural gas, which has a lower temperature as compared to the heat exchanger feed stream 245. In an embodiment, the heat exchanger process unit outlet stream 290 has a temperature of less than about 0° F., or alternately less than about −60° F., or alternately less than about −75° F., or alternately less than about −100° F., or alternately less than about −120° F. In an embodiment, the heat exchanger process unit outlet stream 290 contains at least 90 mol % methane, or alternately at least 92 mol % methane at least 95 mol % methane, or alternately at least 97 mol % methane. In an embodiment, the heat exchanger process unit outlet stream 290 contains less than about 0.01 mol % $CO_2$. In an embodiment, the heat exchanger process unit outlet stream 290 contains less than about 2 mol % ethane.

(D) Heat Exchanger Drain System

Figure 3:
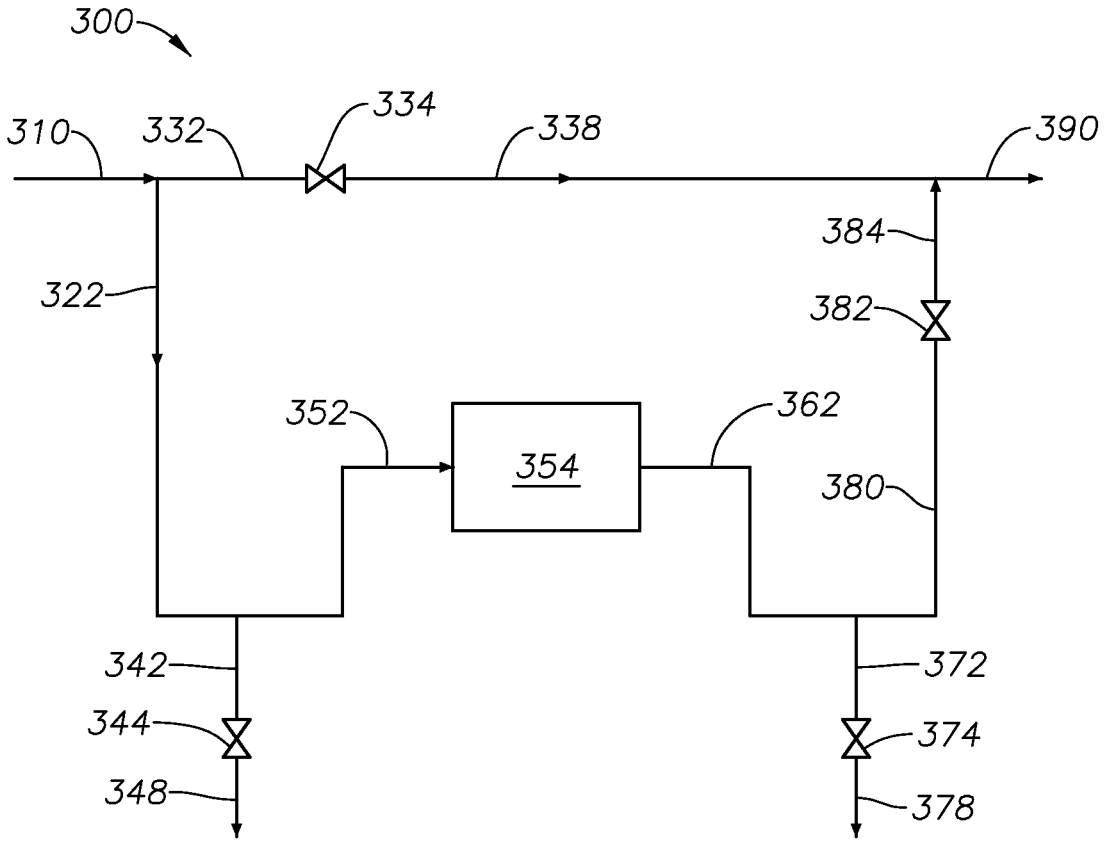
FIG. 3 is a process flow diagram of a heat exchanger drain system according to an embodiment.

A heat exchanger process flow diagram is shown in FIG. 3 according to an embodiment. FIG. 3 shows an embodiment for a heat exchanger drain system 300 for an LNG facility. In an embodiment, one purpose of the heat exchanger drain system 300 is to remove heavy hydrocarbons from the pipeline quality natural gas. In an embodiment, the heavy hydrocarbons contaminated with lubrication oil congeal and form a viscous liquid in the heat exchanger. Removing the lubrication oil contaminated heavy hydrocarbons reduces the generation of congealed or consolidated liquids, solids, or gels that could potentially clog the heat exchanger and equipment downstream.

According to an embodiment, a natural gas stream 310 is introduced to the heat exchanger drain system 300. The natural gas stream 310 includes pipeline quality natural gas contaminated with heavy hydrocarbons and lubrication oil. In an embodiment, the natural gas stream 310 contains at least 90 mol % methane. In an embodiment, the natural gas stream 310 contains at least 92 mol % methane. In an embodiment, the natural gas stream 310 contains at least 95 mol % methane. In an embodiment, the natural gas stream 310 contains at least 97 mol % methane. In an embodiment, the natural gas stream 310 has a C6+ concentration of less than 0.1 mol %. In an embodiment, the natural gas stream 310 has a C6+ concentration of less than 0.05 mol %. In an embodiment, the natural gas stream 310 has a low concentration of C14+ hydrocarbons. In an embodiment, the natural gas stream 310 has a concentration of C14+ hydrocarbons of less than 1,000 ppm. In an embodiment, the natural gas stream 310 has a concentration of C14+ hydrocarbons of less than 100 ppm. In an embodiment, the natural gas stream 310 has a concentration of water vapor of less than 0.01 mol %. In an embodiment, the natural gas stream 310 has a concentration of $CO_2$ of less than 0.02 mol %. In an embodiment, the natural gas stream 310 has a concentration of $CO_2$ of less than 0.01 mol %. In an embodiment, the natural gas stream 310 is less than about 80° F. In an embodiment, the natural gas stream 310 is less than about 65° F. In an embodiment, the natural gas stream 310 has already undergone some cryogenic treatment, and is at a temperature less than 0° F. In an embodiment, the natural gas stream 310 is less than −20° F. The natural gas stream 310 can be previously treated in inlet treatment such as water removal or acid gas removal.

According to an embodiment, the natural gas stream 310 is split into a bypass portion 332 and a heat exchanger feed stream 322. The bypass portion 332 and the heat exchanger feed stream 322 can have the same operating conditions and composition. In an embodiment, a heat exchanger 354 has a design throughput, where the design throughput is calculated based on the operational and design conditions of the heat exchanger 354 and the associated equipment, as well as traditional thermodynamic modeling. In an embodiment, the heat exchanger feed stream 322 is less than the design throughput of the heat exchanger 354. In an embodiment, the heat exchanger feed stream 322 is less than 60% of the design throughput.

According to an embodiment, the bypass portion 332 is fully controlled or partially controlled by a bypass valve 334. The bypass valve 334 can be any type of valve. In a preferred embodiment, the bypass valve 334 is a variable valve that can partially open and close to regulate the flow of fluid going through the bypass valve 334. In an embodiment, the bypass valve 334 is remotely controlled. In an embodiment, the bypass valve 334 is actuated. The bypass portion 332 flows through the bypass valve 334 to generate the bypass stream 338. The bypass stream 338 can have the same composition and operational conditions as the bypass portion 332. In an embodiment, the bypass stream 338 is 10% of the flow of the natural gas stream 310. In an embodiment, the bypass stream 338 is 25% of the flow of the natural gas stream 310. In an embodiment, the bypass valve 334 is a variable open valve where the valve can be fully open, fully closed, or a percentage open in between the two positions. In an embodiment, the bypass valve 334 is open 33% of full open. In an embodiment, the bypass valve 334 is open between 25% of full open and 50% of full open. In an embodiment, the bypass valve 334 is open between 30% of full open and 60% of full open.

According to an embodiment, the heat exchanger feed stream 322 contains heavy hydrocarbons and a contaminant. In an embodiment, the contaminant is a lubrication oil. In an embodiment, the contaminant is a lubrication oil containing an additive package. In an embodiment, the lubrication oil can cause the heavy hydrocarbons to conglomerate, generating a viscous liquid. In an embodiment, the viscous liquid forms at a higher temperature than is predicted in thermodynamic modeling.

In an embodiment, the heat exchanger feed stream 322 includes a low point in the piping. According to an embodiment, heavy hydrocarbons can congeal, liquefy, or collect in the low points of the piping carrying the heat exchanger feed stream 322 before the heat exchanger feed stream is introduced to the heat exchanger 354.

According to an embodiment, an upstream drain 342 is removed from the heat exchanger feed stream 322, generating a heat exchanger inlet stream 352. The upstream drain 342 is optional. The upstream drain 342 contains primarily heavy hydrocarbons that have congealed or liquefied in the heat exchanger feed stream 322. In an embodiment, the upstream drain 342 contains liquefied, congealed, or solidified hydrocarbons with carbon counts of 6 to 40. According to an embodiment, the upstream drain 342 contains from 0.01 wt % to 3.00 wt % of each of the hydrocarbon species from C5 to C19; from 1.0 wt % to 25 wt % of each of the hydrocarbon species from C20 to C34, and from 0.01 wt % to 3.00 wt % of each of the hydrocarbon species from C35 to C40+.

According to an embodiment, the flow of the upstream drain 342 is controlled by an upstream drain valve 344. The upstream drain valve 344 can be any type of valve that isolates the upstream drain 342. In an embodiment, the upstream drain valve 344 is operated manually. In an embodiment, the upstream drain valve 344 is operated remotely. The upstream drain valve 344 can be actuated. In an embodiment, the upstream drain valve 344 is opened automatically based on pressure build up in the heat exchanger 354. The upstream drain valve 344 can be operated based on a time schedule, opening automatically or manually after a period of time to prevent accumulation of heavy hydrocarbons. According to an embodiment, an upstream heavy hydrocarbon stream 348 flows from the upstream drain valve 344 when the upstream drain valve is opened. The upstream heavy hydrocarbon stream 348 can have the same composition and operational conditions as the upstream drain 342. In an embodiment, the upstream heavy hydrocarbon stream 348 is directed to a liquids holding tank, a separation facility, or a knock-out drum (not shown).

According to an embodiment, the heat exchanger inlet stream 352 is generated after the removal of the upstream drain 342. In an embodiment, where there is no upstream drain 342, the heat exchanger inlet stream 352 has the same composition and operational conditions as the heat exchanger feed stream 322. In an embodiment, where the upstream drain 342 is present and is removed from the heat exchanger feed stream 322, the heat exchanger inlet stream has a lower mol % concentration of heavy hydrocarbons in the heat exchanger inlet stream 352 than the mol % concentration of heavy hydrocarbons in the heat exchanger feed stream 322.

According to an embodiment, the heat exchanger inlet stream 352 is introduced to the heat exchanger 354. In an embodiment, the heat exchanger 354 is an ethylene heat exchanger that uses cooled ethylene to drop the temperature of the heat exchanger feed stream 322. According to an embodiment, the heat exchanger 354 is operable to reduce the temperature of the heat exchanger feed stream 322 by at least approximately 50° F. According to an embodiment, the heat exchanger 354 is operable to reduce the temperature of the heat exchanger feed stream 322 by at least approximately 70° F. In an embodiment, the heat exchanger 354 utilizes a cooled gas such as ethylene as the cooling medium.

According to an embodiment, a heat exchanger outlet stream 362 is removed from the heat exchanger 354. The heat exchanger outlet stream 362 contains methane, ethane, and some heavy hydrocarbons. The heat exchanger outlet stream 362 has a lower temperature than the heat exchanger inlet stream 352. In an embodiment, the heat exchanger outlet stream 362 has a temperature of less than 50° F. In an embodiment, the heat exchanger outlet stream 362 has a temperature of less than 0° F. In an embodiment, the heat exchanger outlet stream 362 has a temperature of less than −60° F., or alternately less than −75° F., or alternately −100° F., or alternately −120° F. The heat exchanger outlet stream 362 contains at least 90 mol % methane, or alternately at least 92 mol % methane, or alternately at least 95 mol % methane, or alternately at least 97 mol % methane. In an embodiment, the heat exchanger outlet stream 362 contains less than about 0.01 mol % $CO_2$. In an embodiment, the heat exchanger outlet stream 362 contains less than about 2 mol % ethane. In an embodiment, the heat exchanger outlet stream 362 has a pressure in the range of about 700 psig to about 900 psig.

According to an embodiment, a downstream drain 372 is removed from the heat exchanger outlet stream 362, generating a treated heat exchanger outlet stream 380. The downstream drain 372 contains primarily heavy hydrocarbons that have congealed or liquefied in the heat exchanger 354 or the heat exchanger outlet stream 362. In an embodiment, the downstream drain 372 contains liquefied, congealed, or solidified C20+ hydrocarbons. According to an embodiment, the downstream drain 372 has the same or similar composition as the upstream drain 342. According to an embodiment, the flow of the downstream drain 372 is controlled by a downstream drain valve 374. The downstream drain valve 374 can be any type of valve that isolates the downstream drain 372. In an embodiment, the downstream drain valve 374 is operated manually. In an embodiment, the downstream drain valve 374 is operated remotely. The downstream drain valve 374 can be actuated. In an embodiment, the downstream drain valve 374 is opened automatically based on pressure build up in the heat exchanger 354. The downstream drain valve 374 can be operated based on a time schedule, opening automatically or manually after a period of time to prevent accumulation of heavy hydrocarbons. A downstream heavy hydrocarbon stream 378 flows from the downstream drain valve 374 when the downstream drain valve 374 is opened. The downstream heavy hydrocarbon stream 378 can have the same composition and operational conditions as the downstream drain 372. In an embodiment, the downstream heavy hydrocarbon stream 378 is directed to a liquids holding tank, a separation facility, or a knock-out drum (not shown).

According to an embodiment, after the removal of the downstream drain 372, the treated heat exchanger outlet stream 380 is generated. In an embodiment, the treated heat exchanger outlet stream 380 has a lower mol % concentration of heavy hydrocarbons than in the mol % concentration of heavy hydrocarbons in the heat exchanger outlet stream 362.

According to an embodiment, the treated heat exchanger outlet stream 380 flows through a heat exchanger outlet flow control valve 382. The heat exchanger outlet flow control valve 382 can be any type of valve. In a preferred embodiment, the heat exchanger outlet flow control valve 382 is a variable valve that can partially open and close to regulate the flow of fluid going through the heat exchanger outlet flow control valve 382. In an embodiment, the heat exchanger outlet flow control valve 382 is remotely controlled. In an embodiment, the heat exchanger outlet flow control valve 382 is actuated. In an embodiment, the heat exchanger outlet flow control valve 382 controls the flow through the heat exchanger 354. In an embodiment, the heat exchanger outlet flow control valve 382 and the bypass valve 334 controls the flow through the heat exchanger 354. In an embodiment, the heat exchanger outlet flow control valve 382 is a variable open valve where the valve can be fully open, fully closed, or a percentage open in between the two positions. In an embodiment, the heat exchanger outlet flow control valve 382 is open 50% of full open. In an embodiment, the heat exchanger outlet flow control valve 382 is open between 30% of full open and 60% of full open. In an embodiment, the heat exchanger outlet flow control valve 382 is open between 50% of full open and fully open.

According to an embodiment, the treated heat exchanger outlet stream 380 flows through the heat exchanger outlet flow control valve 382 to generate the cooled natural gas stream 384. The cooled natural gas stream 384 can have the same composition as the treated heat exchanger outlet stream 380.

According to an embodiment, the cooled natural gas stream 384 is combined with the bypass stream 338 to form a combined outlet stream 390. The composition of the combined outlet stream 390 is dependent upon the composition of the bypass stream 338 and the cooled natural gas stream 384, as well as on the quantities and flow rates of the bypass stream 338 and the cooled natural gas stream 384. The temperature and other operational conditions of the combined outlet stream 390 is dependent upon the temperature and operational conditions of the bypass stream 338 and the cooled natural gas stream 384, as well as on the quantities and flow rates of the bypass stream 338 and the cooled natural gas stream 384. The combined outlet stream 390 can then be introduced to another treatment unit in the LNG facility.

(E) Inlet Gas Treatment Beds

In an embodiment, the lubrication oil contaminated heavy hydrocarbons are removed during the inlet treating portion of the LNG facility through a treatment bed. In an embodiment, the treatment beds are positioned on the inlet natural gas supply pipeline past the LNG facility custody transfer point. In an embodiment, the treatment beds are positioned on the inlet natural gas supply pipeline immediately following the pressure let-down station. The pressure let-down station contains valves and equipment used to reduce and stabilize inlet gas pressure. In an embodiment, the treatment beds are positioned upstream of the amine contactor in the acid gas removal unit. In an embodiment, the treatment beds are positioned upstream of the molecular sieve dehydration beds.

Figure 4:
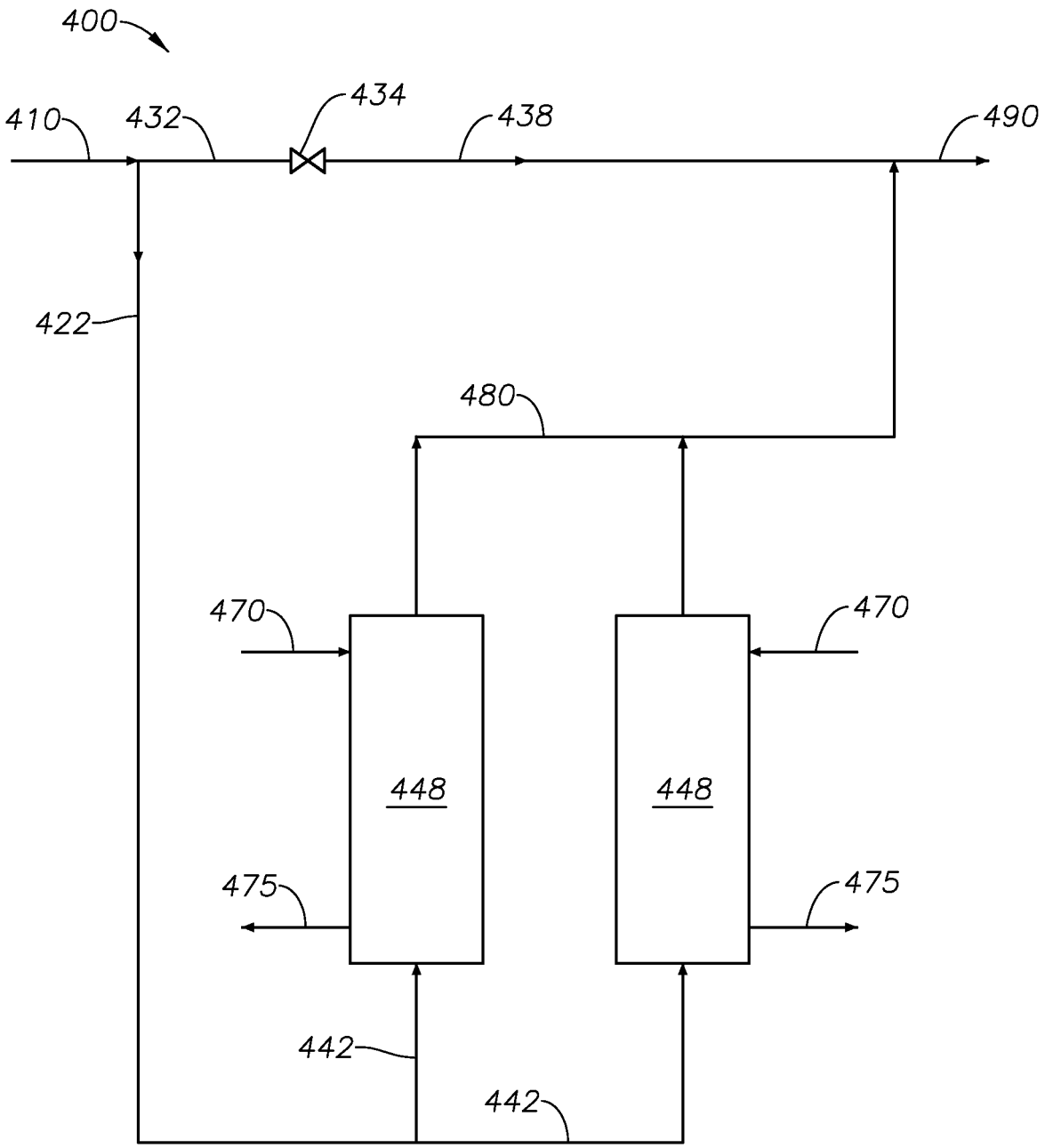
FIG. 4 is a process flow diagram of heavy hydrocarbon removal beds according to an embodiment.

Referring to FIG. 4, the natural gas can be treated in a treatment bed system 400 according to an embodiment. An inlet natural gas stream 410 is introduced to the treatment bed system 400. According to an embodiment, the inlet natural gas stream 410 includes pipeline quality natural gas. According to an embodiment, the inlet natural gas stream 410 has not gone through the initial treatment stages at an LNG facility including dehydration and acid gas removal. In an alternate embodiment, the inlet natural gas stream 410 has gone through the initial treatment stages at an LNG facility.

According to an embodiment, the inlet natural gas stream 410 includes pipeline quality natural gas contaminated with heavy hydrocarbons and lubrication oil. In an embodiment, the inlet natural gas stream 410 contains at least 90 mol % methane. In an embodiment, the inlet natural gas stream 410 contains at least 92 mol % methane. In an embodiment, the inlet natural gas stream 410 contains at least 95 mol % methane. In an embodiment, the inlet natural gas stream 410 contains at least 97 mol % methane. In an embodiment, the inlet natural gas stream 410 has a C6+ concentration of less than 0.5 mol %. In an embodiment, the inlet natural gas stream 410 has a C6+ concentration of less than 0.1 mol %. In an embodiment, the inlet natural gas stream 410 has a low concentration of C14+ hydrocarbons. In an embodiment, the inlet natural gas stream 410 has a concentration of C14+ hydrocarbons of less than 1,000 ppm. In an embodiment, the inlet natural gas stream 410 has a concentration of C14+ hydrocarbons of less than 100 ppm. In an embodiment, the inlet natural gas stream 410 has a concentration of water vapor of less than 0.1 mol %. In an embodiment, the inlet natural gas stream 410 has a concentration of $CO_2$ of less than 0.5 mol %. In an embodiment, the inlet natural gas stream 410 has a concentration of $CO_2$ of less than 0.1 mol %. In an embodiment, the inlet natural gas stream 410 is less than about 80° F. In an embodiment, the inlet natural gas stream 410 is less than about 65° F.

According to an embodiment, the inlet natural gas stream 410 is split into a treatment bed stream 422 and a bypass portion 432. The bypass portion 432 and the treatment bed stream 422 can have the same operating conditions and composition. The bypass portion 432 can be controlled by a bypass valve 434. The bypass valve 434 can be any type of valve. In a preferred embodiment, the bypass valve 434 is a variable valve that can partially open and close to regulate the flow of fluid going through the bypass valve 434. In an embodiment, the bypass valve 434 is remotely controlled. In an embodiment, the bypass valve 434 is actuated. The bypass portion 432 flows through the bypass valve 434 to generate the bypass stream 438. The bypass stream 438 can have the same composition and operational conditions as the bypass portion 432.

In an embodiment, the treatment bed stream 422 is split to generate the treatment bed feed stream 442. The treatment bed feed stream 442 has the same composition and operational conditions as the treatment bed stream 422. In an embodiment, the treatment bed feed stream 442 is introduced to a treatment bed 448. In an embodiment, the treatment bed 448 is designed to absorb or adsorb heavy hydrocarbons including the chemical compounds contaminating the stream from lubrication oil, thus removing them before the natural gas is further treated and the heavy hydrocarbons and lubrication oils can conglomerate in systems throughout the LNG facility.

According to an embodiment, the treatment bed 448 is an absorption bed. According to another embodiment, the treatment bed 448 is an adsorption bed. According to an embodiment, the treatment bed 448 is a sacrificial bed, so that when the media filling the bed has absorbed or adsorbed as much of the heavy hydrocarbons as is efficient, and thus has reached the end of the media's lifespan, the media is removed from the treatment bed 448 and is discarded.

According to an embodiment, the treatment bed 448 is a regenerative bed, so that when the media filling the bed has absorbed or adsorbed as much of the heavy hydrocarbons as is efficient, the media is regenerated using a heated regen gas stream 470, which removes the absorbed or adsorbed components from the media. In an embodiment, the absorbed or adsorbed components are carried out of the treatment bed 448 by a saturated regen gas stream 475. In an embodiment, the heated regen gas stream 470 is at a temperature in excess of 600° F. In an embodiment, the heated regen gas stream 470 is at a temperature in excess of 750° F. In an embodiment, the heated regen gas stream 470 is at a temperature of about 1000° F. In an embodiment, the heated regen gas stream 470 is at a temperature substantially above the temperature that a thermodynamic model predicted would be necessary to regenerate the media. In an embodiment, the need for the heated regen gas stream 470 to have a temperature in excess of a traditional regen gas stream is due to the contamination of the heavy hydrocarbons with lubrication oils.

EXAMPLES

Example I: ASPEN HYSYS® Modeling Prediction Inaccuracy

A typical thermodynamic modeling package (ASPEN HYSYS®) was used to investigate the predictive ability of the modeling package compared to laboratory data. A trial was done comparing the ASPEN HYSYS® models of sampled streams and the actual lab results. To generate the ASPEN HYSYS® model, a sample was taken from a liquid knockout drum positioned on the inlet natural gas line, located upstream of the main cryogenic unit, of the LNG facility treating pipeline quality natural gas contaminated with lubrication oils. Liquids collected in the liquid knockout drum have a long residence time, and therefore any sample collected from liquids in the liquid knockout drum would be representative of the liquids in the natural gas stream that are at such low concentrations they cannot be isolated elsewhere. The sample is considered representative of the types of congealed materials being drained from the heat exchanger at the LNG facility treating pipeline quality natural gas contaminated with lubrication oils. The sample data was then inputted into the ASPEN HYSYS® model to predict vapor/liquid interactions, and then compared with the lab results and experimental data.

To generate the ASPEN HYSYS® input, the C1 through C9 component concentrations were reported individually by specific component (e.g., n-butane was reported separately from isobutane). The ASPEN HYSYS® database thermodynamic and physical characteristics were used for components contained in the ASPEN HYSYS® database. For components not included in the ASPEN HYSYS® database, individual pseudo components were created using published physical property information. For C10+ components, the lab results were consolidated by carbon number (e.g., all C12 components were consolidated and reported as C12). Each carbon number group was then approximated as a straight-chain alkane of that carbon number. The ASPEN HYSYS® database thermodynamic and physical characteristics were used for the C10+ alkanes with information in the ASPEN HYSYS® database. For C10+ alkanes not in the ASPEN HYSYS® database, individual pseudo components were created and used to generate thermodynamic and physical characteristics.

The Peng-Robinson equation of state was selected as the ASPEN HYSYS® modeling computation standard. The ASPEN HYSYS® stream analysis tool was used to generate an ASTM D2887 boiling point curve. The ASPEN HYSYS® generated curve was compared against the actual ASTM D2887 results obtained from the sample analyzed at the lab.

Figure 5:
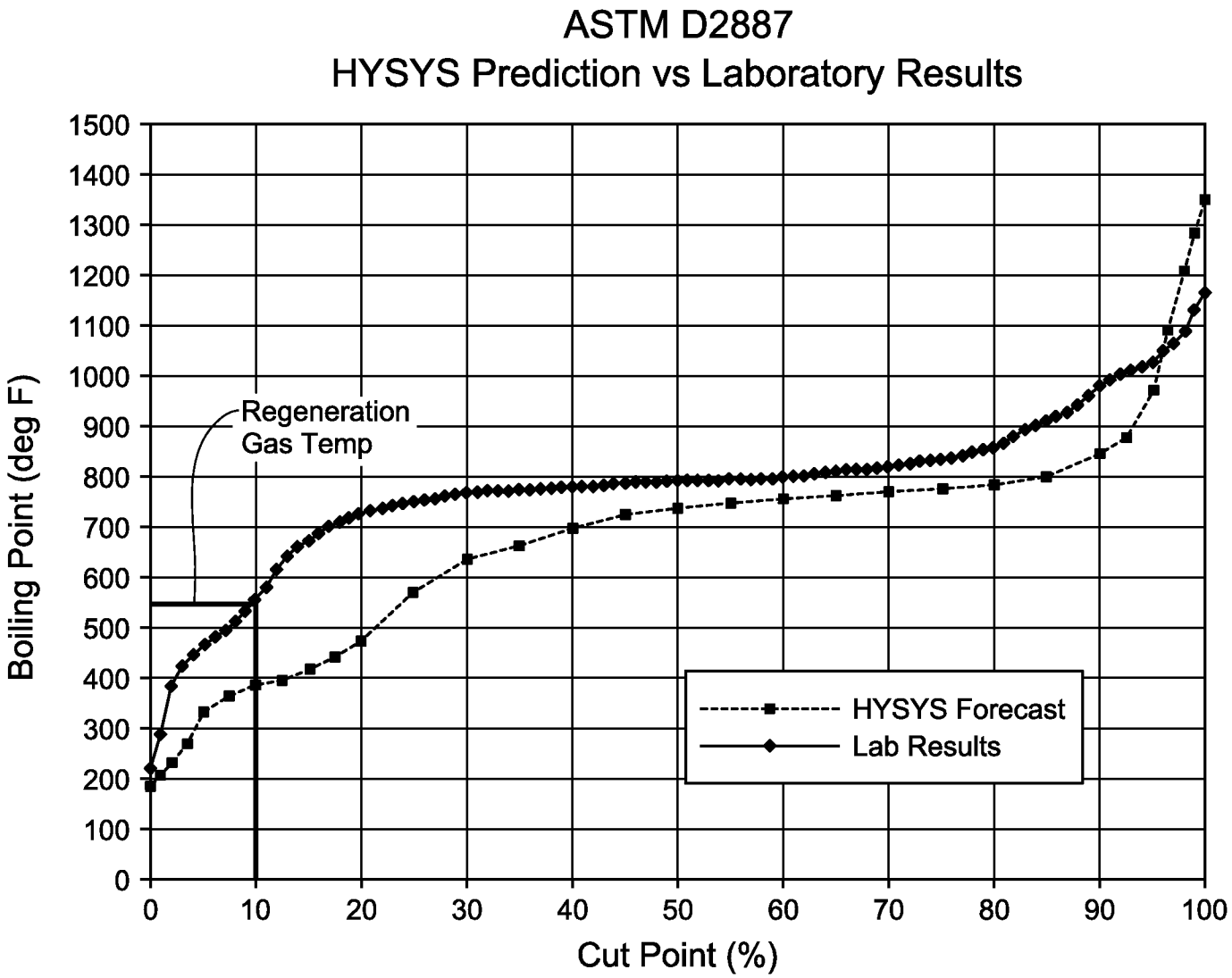
FIG. 5 is a graph depicting the ASTM D2887 boiling point curve as developed by modeling and as tested in a laboratory sample according to an embodiment.

Referring to FIG. 5, the ASPEN HYSYS® generated ASTM D2887 boiling point curve is plotted against the lab result ASTM D2887. The perpendicular lines to the x- and y-axes marks the regeneration gas temperature. The figure shows that ASPEN HYSYS® underestimates the temperatures for the vapor/liquid phase changes by as much as 250° F. for the lower cut points, but also overestimates the temperature for the vapor/liquid phase changes at the high end of the cut point by about 200° F. In other words, ASPEN HYSYS® predicts boiling curves at lower temperatures than actually observed. Due to the actual temperatures and pressures experienced in the inlet areas where the regenerative beds are located, even greater temperature differences between the predicted and actual regeneration gas temperatures are expected.

This data shows that lubrication oil containing additive packages designed to bind molecules together preventing thermal and viscosity breakdown, then higher boiling points than expected would be an effect of the additives. This also shows that the predicted regeneration gas temperature based on thermodynamic modeling would be far too low to regenerate bed media, as the heavy hydrocarbons would require a much higher temperature to vaporize and be removed from the bed media.

Example II: Train A Drains

A trial was performed on a train in an LNG facility treating pipeline quality natural gas contaminated by lubrication oils. The objective of the trial was to stabilize the large swings in the observed pressure drop by reducing the potential impact of liquid holdup on the pressure instruments downstream of the heat exchanger in question; and reducing normalized pressure drop to facilitate increasing the flow through the exchanger to increase production rates.

The upstream drain was opened to reduce the potential to carryover liquid from the low point to the exchanger during ramp-up. The downstream drain was opened to reduce liquid holdup in the low points, the outlet piping, and the core of the exchanger.

The drains were opened manually. The first 4 days of the trial, the drains were opened approximately 3 times per day. For the following 3 days, the drains were not opened. After seven days of the trial, the drains were opened once per day.

Figure 6:
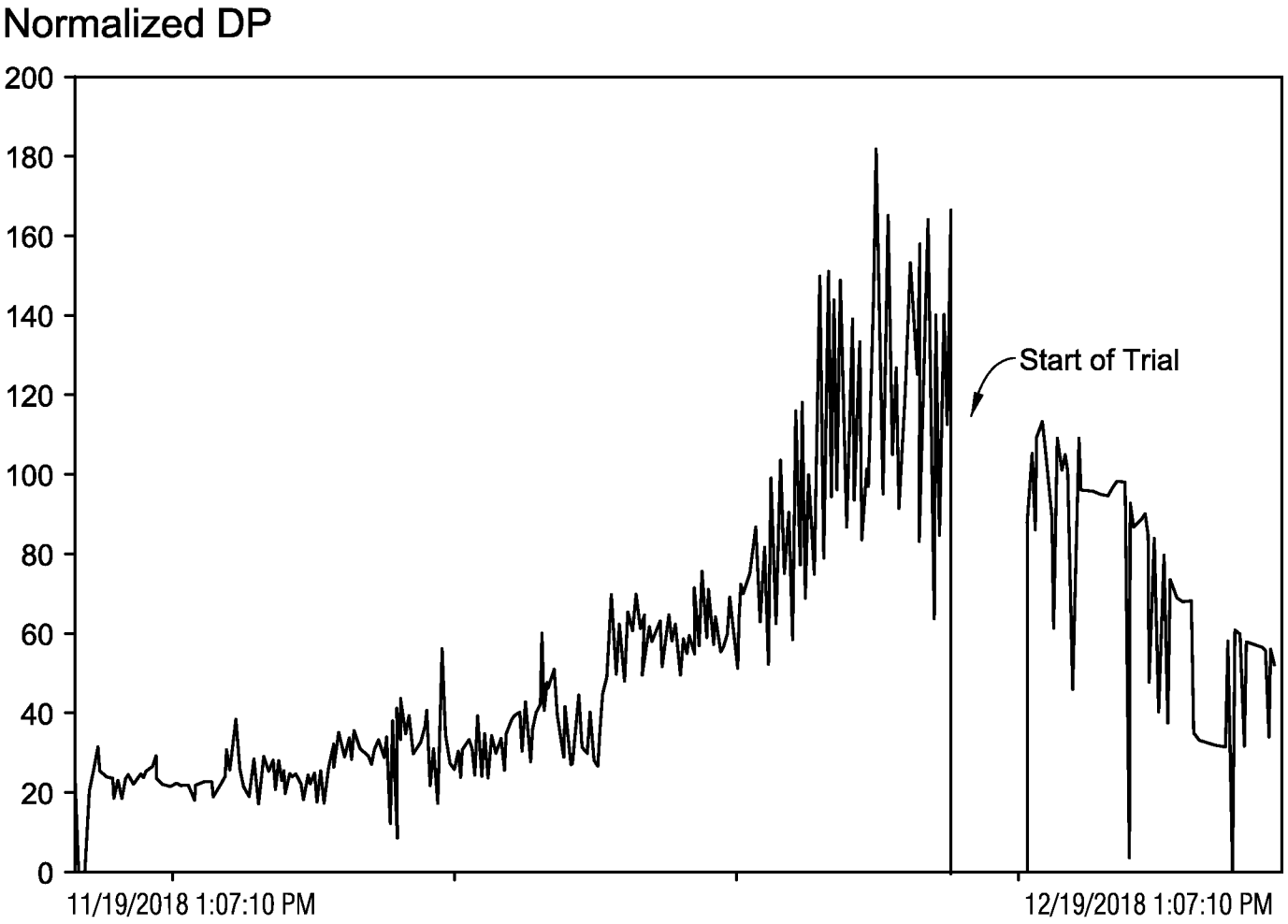
FIG. 6 is a graph depicting the normalized differential pressure in a heat exchanger in one LNG facility train over a period of time when drains were introduced according to an embodiment.

The result is shown in FIG. 6. The normalized differential pressure (the actual differential pressure as compared to the design differential pressure) is shown in the graph. Draining had a significant effect on reducing the normalized differential pressure. Draining has the surprising and unexpected result of a slow release from the heat exchanger core which results in a reduction in differential pressure without affecting the operation of the heat exchanger.

Flow throughput of the heat exchanger was compared from the start of the trial to data from approximately 8 days into the trial. Flow throughput was estimated using computer modeling based on the available pressure and temperature information. The estimated throughput increased by approximately 50% due to the change in differential pressure and the ability to process more gas with the increased throughput because of the lack of the need to decrease the throughput to keep the differential pressure within safe parameters.

Example II: Train B Drains

Figure 7:
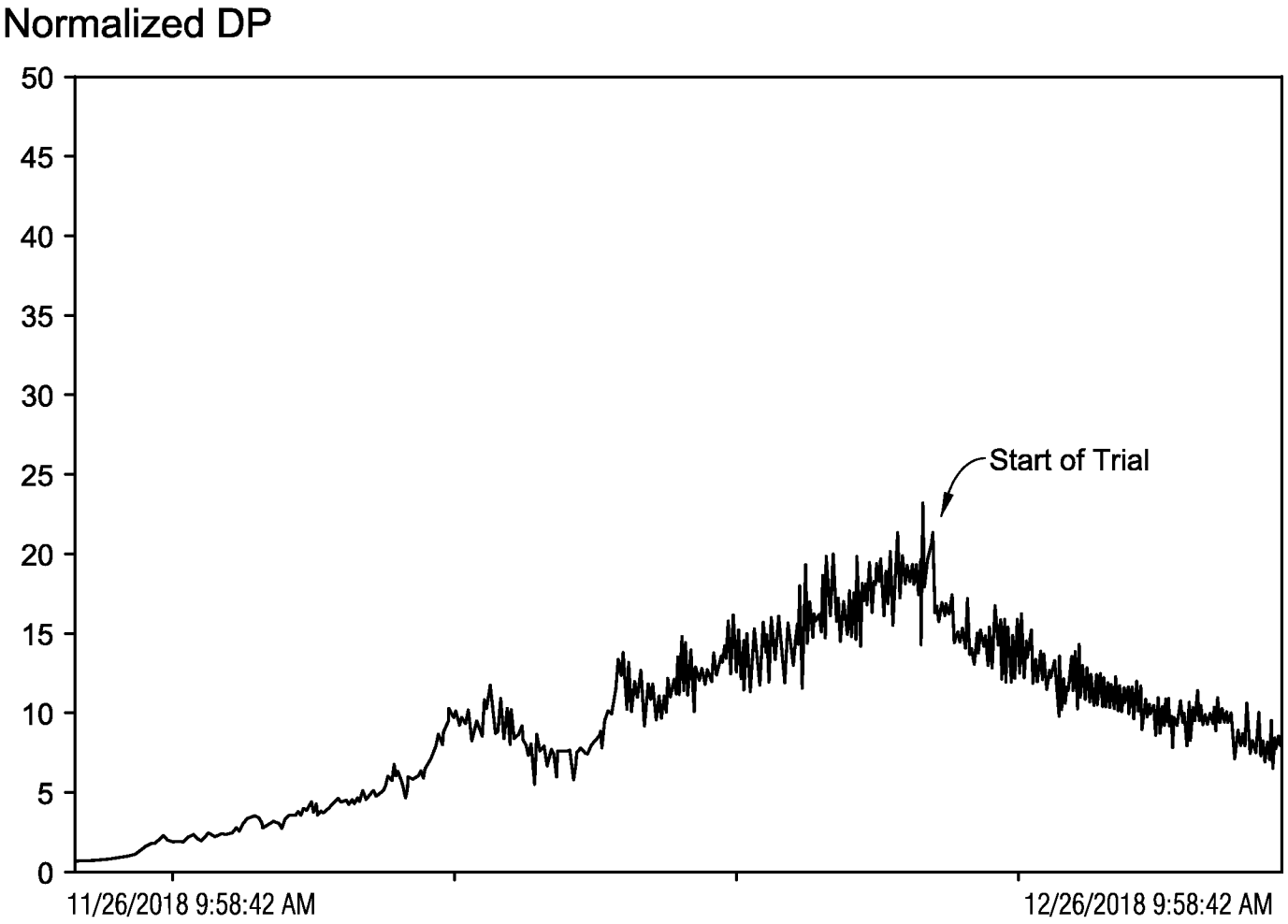
FIG. 7 is a graph depicting the normalized differential pressure in a heat exchanger in another LNG facility train over a period of time when drains were introduced according to an embodiment.

In another example, a trial was performed on a train in an LNG facility treating pipeline quality natural gas contaminated by lubrication oils. In this example, the upstream and downstream drains on a heat exchanger in a train in an LNG facility where opened three times per day for three days, then daily after. The differential pressure over the past month is shown in FIG. 7. The normalized differential pressure reduced to 40% of the original value over 9 days. The flow rate through the heat exchanger was also increased.

Therefore, it can be seen that there is an unexpected and surprising result of installing drains on the upstream and downstream lines of a heat exchanger to remove heavy hydrocarbons.

Although the present disclosure has been described in detail, it should be understood that various changes, substitutions, and alterations can be made without departing from the principle and scope of the disclosure. Accordingly, the scope of the present disclosure should be determined by the following claims and their appropriate legal equivalents.

The invention claimed is:

1. A method for preventing heat exchanger operation loss by removing contaminants, the method comprising the steps of:

introducing a natural gas stream to an LNG facility, wherein the natural gas stream has been transported long distances in pipelines requiring compression, such that the natural gas has come into contact with a lubrication oil, wherein the lubrication oil comprises a contaminant, and wherein the natural gas stream comprises methane, ethane, and a plurality of heavy hydrocarbon species;

reducing the temperature of the natural gas stream in a heat exchanger such that the contaminant in the lubrication oil allows for a conglomeration of the heavy hydrocarbon species; and removing the conglomeration of the heavy hydrocarbon species from the heat exchanger through a drain, such that the conglomeration of the heavy hydrocarbons is removed preventing a blockage in the heat exchanger, wherein the blockage would require a defrost to remove, wherein the removing step comprises removing an upstream heavy hydrocarbon stream using an upstream piping low point drain line, wherein the upstream heavy hydrocarbon stream comprises the conglomeration of the heavy hydrocarbon species, and wherein the contaminant is selected from a group consisting of: an additive in a lubrication oil additive package, a plurality of C20+ compounds, a plurality of C40+ compounds, an additive which causes conglomeration of hydrocarbons, and combinations of the same.

2. The method according to claim 1, further comprising the steps of:

providing the heat exchanger with a first throughput based on a design throughput; wherein the design throughput is calculated from a traditional thermodynamic model and design operational conditions of the heat exchanger, such that the design throughput is an amount of natural gas throughput the heat exchanger can efficiently treat within safety and operational limits; and reducing the amount of natural gas sent to the heat exchanger, such that the heat exchanger is provided with a second throughput, wherein the second throughput is less than the design throughput.

3. The method according to claim 2, wherein the second throughput is less than 75% of the first throughput.

4. The method according to claim 1, wherein the natural gas stream meets an interstate pipeline quality standard.

5. The method of claim 1, further comprising the steps of:

calculating a design heat exchanger throughput based on thermodynamic modeling and a set of design parameters established for the heat exchanger; and operating the heat exchanger with a reduced throughput, wherein the reduced throughput is less than the design heat exchanger throughput.

6. The method of claim 5, wherein the step of operating the heat exchanger with the reduced throughput is performed through manipulating a bypass valve and a heat exchanger outlet flow control valve.

7. The method of claim 6, wherein the heat exchanger outlet flow control valve is set at an outlet flow control valve position, wherein the outlet flow control valve position is 33% of full open, and wherein the bypass valve is set at a bypass valve position, wherein the bypass valve position is 50% of full open.

8. The method of claim 5, wherein the reduced throughput is less than 60% of the design heat exchanger throughput.

9. The method of claim 1, wherein the upstream piping low point drain line is allowed to drain during ramp-up such that there is a reduction in a potential to carryover liquid.

10. The method of claim 1, wherein the natural gas stream has a condensation temperature such that the condensation temperature is the temperature at which liquids and solids begin to form based on the composition of the natural gas stream and the known thermodynamic properties available in traditional thermodynamic modeling packages;

wherein the heat exchanger is operable to reduce the temperature of a heat exchanger feed stream to a heat exchanger outlet stream temperature above the condensation temperature; and wherein the heat exchanger is inundated with solids, liquids, and a congealed heavy hydrocarbon.

11. The method of claim 1, wherein the natural gas stream has a condensation temperature such that the condensation temperature is the temperature at which liquids and solids begin to form based on laboratory testing of the downstream heavy hydrocarbon stream;

wherein the heat exchanger is operable to reduce the temperature of a heat exchanger feed stream to a heat exchanger outlet stream temperature below the condensation temperature; and wherein a solid ice does not form in the heat exchanger.

12. The method of claim 1, wherein the natural gas stream comprises pipeline quality natural gas.

* * * * *